US006753512B1

(12) United States Patent
Triplett et al.

(10) Patent No.: US 6,753,512 B1
(45) Date of Patent: Jun. 22, 2004

(54) MODEL-BASED CONTROL SYSTEM FOR THERMALLY TREATING WEBS

(75) Inventors: Jeffrey S. Triplett, Pleasant Garden, NC (US); Edward J. Robbins, Liberty, NC (US); Ricky D. Glaze, Greensboro, NC (US)

(73) Assignee: SimTek, Inc., Greensboro, NC (US)

( * ) Notice: Subject to any disclaimer, the term of this patent is extended or adjusted under 35 U.S.C. 154(b) by 25 days.

(21) Appl. No.: 10/038,764

(22) Filed: Jan. 2, 2002

(51) Int. Cl.[7] ..... H05B 1/02
(52) U.S. Cl. ..... 219/497; 219/388
(58) Field of Search ..... 219/497, 494, 219/506, 388, 414; 392/417; 34/268, 269, 273, 553, 618; 101/424.1

(56) References Cited

U.S. PATENT DOCUMENTS

| | | | | | |
|---|---|---|---|---|---|
| 3,793,741 | A | * | 2/1974 | Smith Jr. | 34/549 |
| 4,202,112 | A | * | 5/1980 | Eltz et al. | 34/266 |
| 4,354,095 | A | * | 10/1982 | Vries | 219/388 |
| 4,605,161 | A | * | 8/1986 | Motomiya et al. | 236/15 BC |
| 4,634,840 | A | * | 1/1987 | Yamagishi et al. | 219/388 |
| 5,010,659 | A | * | 4/1991 | Treleven | 34/269 |
| 5,262,618 | A | * | 11/1993 | Thelen | 219/486 |
| 5,369,894 | A | * | 12/1994 | Schaffer et al. | 34/268 |
| 5,377,428 | A | * | 1/1995 | Clark | 34/446 |
| 5,517,594 | A | * | 5/1996 | Shah et al. | 392/416 |
| 5,895,596 | A | * | 4/1999 | Stoddard et al. | 219/497 |
| 5,916,409 | A | * | 6/1999 | Mosburger | 156/322 |
| 6,169,848 | B1 | * | 1/2001 | Henry | 392/307 |
| 6,606,537 | B1 | * | 8/2003 | Kazmierowicz et al. | 700/210 |

FOREIGN PATENT DOCUMENTS

| | | | |
|---|---|---|---|
| JP | 61-192526 | * | 8/1986 |
| JP | 63-307223 | * | 12/1988 |

OTHER PUBLICATIONS

SimTek, Inc. brochure entitled SimTek's Process Simulation Technology . . . 1991.

SimTek, Inc. brochure entitled "SimTek, Inc. Simulation Technologies" 1994.

SimTek, Inc. brochure entitled Oven Optimization and Maintenance Programs 2001.

SimTek, Inc. brochure entitled Lab–to–Production Technique for Optimal Fabric Temperture Profile; 2001.

SimTek, Inc. brochure entitled "S O P Manager" 2001.

SimTek information sheet entitled "Still Cooking with Heat Tapes?" 1999.

Article from AIT Magazine entitled "How Casual Business Dress Is Changing Industry Strategies" 1996.

SimTek brochure entitled "Have You Ever Asked What If"? 1996.

* cited by examiner

*Primary Examiner*—John A. Jeffery
(74) *Attorney, Agent, or Firm*—MacCord Mason PLLC

(57) ABSTRACT

An oven for thermal treating a web includes: an over chamber; a web transport for transporting a web through the oven chamber; a heater for heating the web in the oven chamber; an exhaust system connected to the oven chamber; a model-based controller for controlling the web temperature profile; and an air delivery system. The model-based controller includes: (i) a plurality of sensor inputs; (ii) a plurality of control signal outputs; (iii) a multi-variable controller with first principles guidelines and oven and process boundaries for a first specific oven; (iv) a desire process profile; and (v) a translator module for permitting the desire process profile to be transferred to at least a second specific oven.

36 Claims, 3 Drawing Sheets

MODEL-BASED CONTROL SYSTEM FOR THERMALLY TREATING WEBS

BACKGROUND OF THE INVENTION (1) Field of the Invention

The present invention relates generally to ovens for thermal treating a web and, more particularly, to an oven for thermally treating a textile fabric web having a model-based control system.

(2) Description of the Prior Art

Product quality is a primary concern of any manufacturing operation. In any process involving the application of heat, over exposure can be detrimental. For example, over exposure to heat of a textile web/fabric can cause yellowing, reduction in strength, harsh hand (feel of the product) and reduction in fastness properties. Likewise, under exposure can result in the purpose of the treatment not being accomplished for example, for a textile web, under exposure may result in a chemical reaction not going to completion, heat sitting not being accomplished, and/or fabric not being sufficiently dried. Heat treatment must also be uniform and consistent to have uniform and consistent quality.

In the textile industry, most ovens or other equipment used for the application of heat to a web utilize various proves, sensors and RTDs (remote temperature device) to sense temperature and to provide feedback information to a control system to maintain a desired temperature within the oven or other equipment. Manufacturing operations have used various devices to measure the temperature a product is exposed to in a particular process. In processing textiles, operators have typically used heat tapes (heat sensitive tape that can be attached to a web/product that changes color at a given temperature) to try to determent thermal exposure. Heat tapes are usually limited to identify a range of temperature, rather than a specific value, do not identify already processed materials.

IR measurement devices have also been used in the textile industry to both measure product exposure temperature and to provide sensor feedback information to a control system that interfaces with the speed of the process, so that speed can be modified and a desired product temperature can be maintained. However, practice has shown that the IR measurement devices have been difficult to maintain and keep in accurate calibration.

If conditions within the oven or heating equipment change, there is presently no equipment, mechanism or method to identify what has changed or what the effect may be on thermal exposure. There is no system of automation that can detect, identify the most likely cause for the changing conditions, and modify processing parameters to compensate for these changes, so that product thermal exposure and therefore quality can be maintained.

In addition to product quality, in the textile industry as well as other industries utilizing heat in the manufacturing process, the energy consumed has always been of concern, but in recent years, with a clearer realization of the finite resources available, there has been a greater effort to conserve energy. Generally, there are two major schools of thought regarding energy conservation in industry: (1) use less energy by operating, in the most energy efficient manner possible(theoretical analyses of process equipment, operating conditions and controls), and/or (2) recover effluent energy (energy leaving the process not consumed by the product).

The cost effectiveness of recovering effluent energy depends on the specific situation but, in many instances, the cost of the equipment to recover the energy involves a high capital investment and creates major maintenance difficulties. The energy that can be recovered is primarily low temperature, which has minimal usefulness, and some moderate temperature, which is more useful. Therefore, in practice, reducing consumption and optimizing processes to document energy consumption, developing instrumentation as necessary, to measure and then devise strategies for maximizing energy conservation for thermal finishing processes in use in the textile industry has proven to be the most fruitful approach.

One goal of a manufacturer is to operate using minimum resources to achieve maximum output, so that the unit cost is as low as possible and profit is maximized. Optimizing manufacturing processes has typically been done in a trial and error mode. Based on experience and laboratory testing, production variables have been identified and, if the desired quality of the end product has been achieved, then standards for production variables have been established. Improvements to a process have generally consisted of trials to refine the established parameters. Trials are costly in production machine time and in the materials consumed in running the trials, and whether or not true optimization has been achieved is not known. Typically, trials conducted on laboratory equipment cannot be directly transferred to production machines without additional production machine trials.

The interdependence and interconnectedness of the variables affecting thermal processing has not been accommodated by prior art control strategies devised thus far for equipment used in heat treating. Control systems typically focus on one variable, i.e., IR measurement of temperature and control of speed, measurement of moisture content in exhaust to control speed.

Thus, there remains a need for a new and improved oven for thermal treating a web, which provides model-based control while, at the same time, includes means for permitting a desired process profile to be transferred from one specific oven to another.

SUMMARY OF THE INVENTION

The present invention is directed to an oven for thermal treating a web. The oven includes: an oven chamber; a web transport for transporting a web through the oven chamber; heating means for heating the web in the oven chamber; an exhaust system connected to the oven chamber; and a model-based controller for controlling the web temperature profile. In the preferred embodiment, the model-based controller includes: (i) a plurality of sensor inputs; (ii) a plurality of control signal outputs; (iii) a multi-variable controller with first principles guidelines and oven and process boundaries for a first specific oven; (iv) a desired process profile; and (v) a translator module for permitting the desired process profile to be transferred to at least a second specific oven.

In the preferred embodiment, the oven further includes an air delivery system including at least one plenum having a plurality of air nozzles and a circulation fan. The air delivery system may include a pressure sensor system for determining thermal potential, such as a $\Delta p$ sensor.

The oven chamber is generally conventional in design and includes an enclosed housing, a web entrance and a web exit. The web transport includes a web let-off means and a web take-up means for transporting the web through the oven. In addition, the web transport may further include a web mass monitor, such as a weight-speed monitor.

The heating means may be convection, radiant, or conduction heating. For example, in the preferred embodiment, the convection means is hot air heating. In addition, the radiant heating means may include infrared, radio frequency, or microwave heating and the conduction means may be a steam heat drum.

In the preferred embodiment, the model-based controller includes: a plurality of sensor inputs; a plurality of control signal outputs; a multi-variable controller with first principles guidelines and oven and process boundaries for a first specific oven; a desired process profile; and a translator module for permitting the desired process profile to be transferred to at least a second specific oven.

The sensor inputs receive measurements of web mass, heating temperature, exhaust rate, and web speed. In addition, the sensor inputs may further include a web mass sensor input. The plurality of control signal outputs may include a web speed control signal and/or a temperature control signal.

In the preferred embodiment, the multi-variable controller with first principles guidelines and oven and process boundaries for a specific oven further includes a model input for problem scenarios. In addition, it may further include a self-check module using a formula based lookup module.

Also, in the preferred embodiment, the translator module includes oven boundaries for at least a second specific oven and a boundary condition converter for producing new oven-specific boundaries for the second specific oven to attain the process profile.

Accordingly, one aspect of the present invention is to provide an oven for thermal treating a web. The oven includes: an oven chamber; a web transport for transporting a web through the oven chamber; heating means for heating the web in the oven chamber; an exhaust system connected to the oven chamber; and a model-based controller for controlling the web temperature profile.

Another aspect of the present invention is to provide a model-based controller for an oven for thermal treating a web, the oven including an oven chamber; a web transport for transporting a web through the oven chamber; heating means for heating the web in the oven chamber; and as exhaust system connected to the oven chamber. The model-based controller includes: a plurality of sensor inputs; a plurality of control signal outputs; a multi-variable controller with first principles guidelines and oven and process boundaries for a first specific oven; a desired process profile; and a translator module for permitting the desired process profile to be transferred to at least a second specific oven.

Still another aspect of the present invention is to provide an oven for thermal treating a web. The oven includes: an oven chamber; a web transport for transporting a web through the oven chamber; heating means for heating he web in the oven chamber; an exhaust system connected to the oven chamber; a model-based controller for controlling the web temperature profile, the model-based controller including: (i) a plurality of sensor inputs; (ii) a plurality of control signal outputs; (iii) a multi-variable controller with first principles guidelines and oven and process boundaries for a first specific oven; (iv) a desired process profile; and (v) a translator module for permitting the desired process profile to be transferred to at least a second specific oven; and an air delivery system.

These and other aspects of the present invention will become apparent to those skilled in the art after a reading of the following description of the preferred embodiment when considered with the drawings.

DESCRIPTION OF THE PREFERRED EMBODIMENTS

Figure 1:
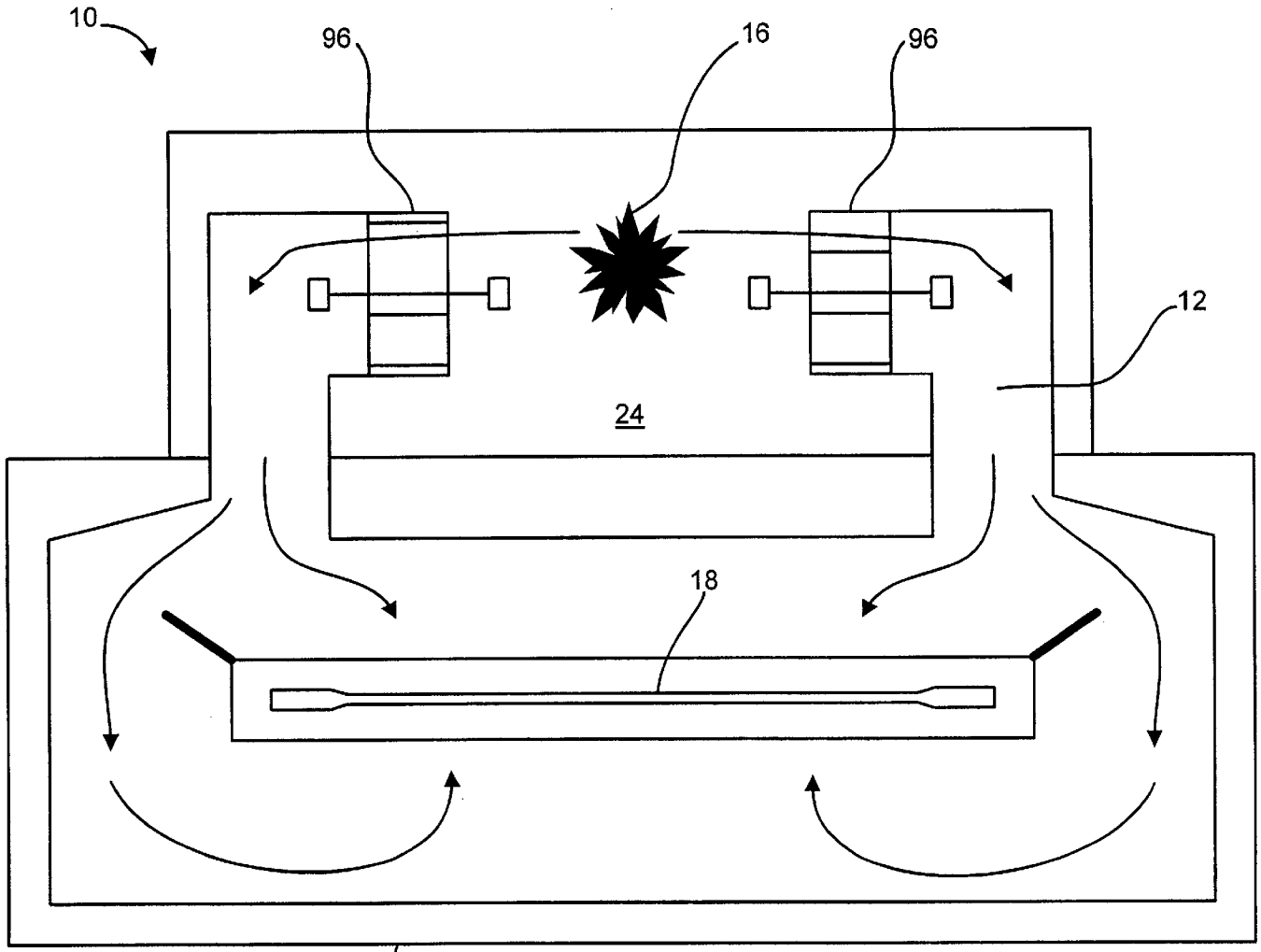
FIG. 1 is a cross sectional view of an oven for use in providing thermal treatment of fabric webs.

In the following description, like reference characters designate like or corresponding parts throughout the several views. Also in the following description, it is to be understood that such terms as "forward," "rearward," "left," "right," "upwardly," "downwardly," and the like are words of convenience and are not to be construed as limiting terms.

Figure 2:
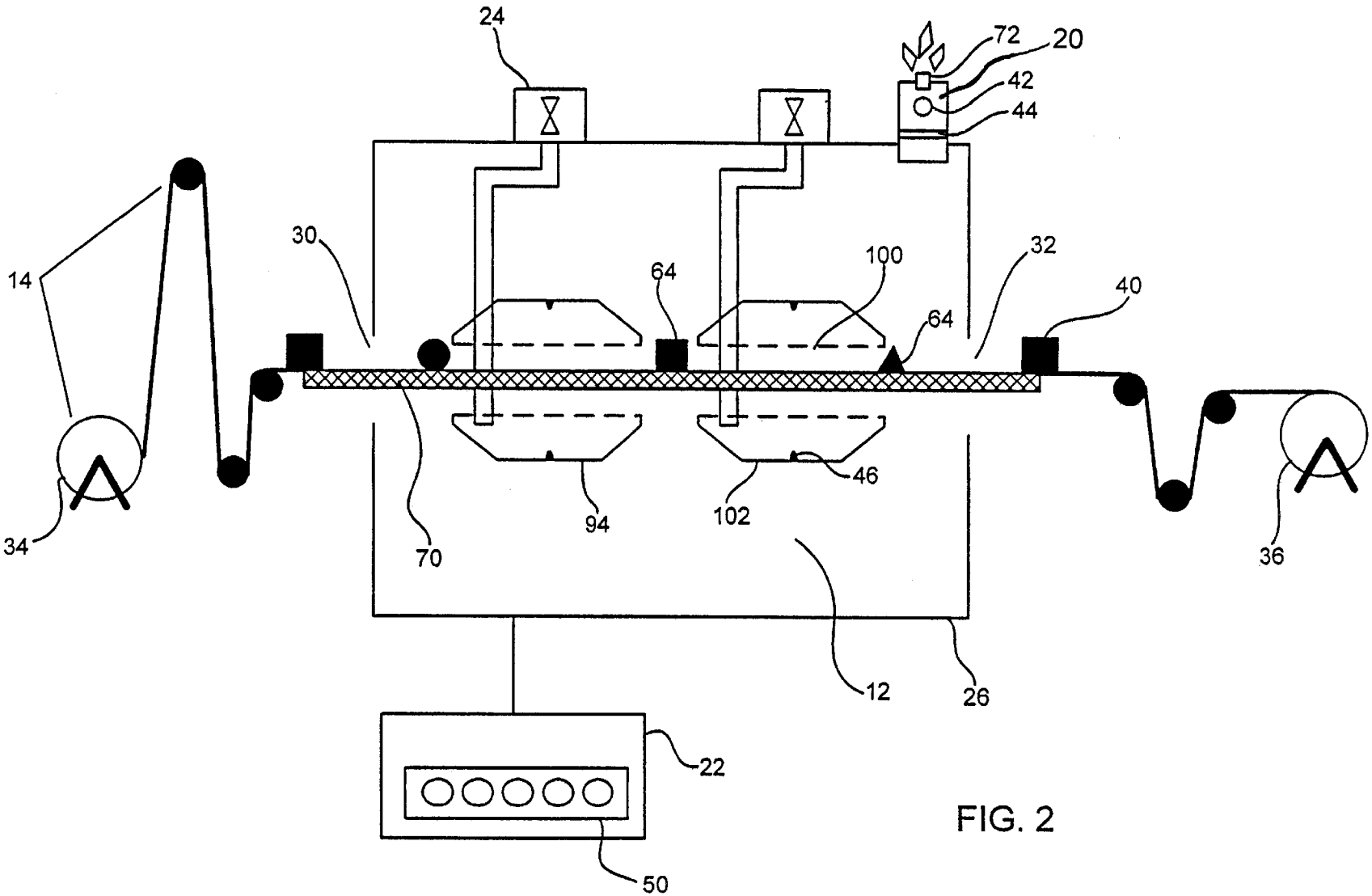
FIG. 2 is a schematic drawing of a thermal oven and other apparatus, including a model-based controller, utilized in thermal treatment of a fabric web.

Referring now to the drawings in general and FIGS. 1 and 2 in particular, it will be understood that the illustrations are for the purpose of describing a preferred embodiment of the invention and are not intended to limit the invention thereto. As best seem in FIGS. 1 and 2, an oven for thermal treatment of a textile fabric web, generally designated 10, is shown constructed according to the present invention. The oven 20 includes: an oven chamber 12, a web transport system 14, a heating means 16, an exhaust system 20, and a model-based controller 22. The oven 10 may also include an air delivery system 24.

In the preferred embodiment, the oven chamber 12 is comprised of an enclosed housing 26, an entrance point 30, and an exit point 32, as best seem in FIG. 2. The web transport system 14 in FIG. 2 is composed of a let off means 34, and a take up means 36. The web transport system 14 also includes web mass monitors 40.

In the preferred embodiment, the web mass monitors are designed to provide constant measurement of mass as it passes thorough the oven. The heating means 16 of FIG. 1 may be convection, radiant, or conduction. The convection heating system provides hot air. The radiant heating system may be comprised of either infrared, radio frequency or microwave technology. The conduction heating system provides steam heat through a steel drum process. The exhaust system 20 in FIG. 2 includes a cross duct and an exhaust fan, items 42 and 44. The empirical monitor controller shown in FIG. 2 is comprised of sensor inputs 46, controls 50, and a variable first principal oven-specific boundary system, the dryer process system, translator module, air delivery system 24, plenums 94 and circulation fans 96.

As best seen in FIG. 1, the plenum, or plenums 94 further includes nozzles 100. The air delivery system 24 also contains circulation fans 96. Also depicted in FIG. 1 is the air delivery system 24, which further includes air pressure sensors determining thermal potential 102. In the preferred embodiment, the air pressure sensors provide input to the model-based controller.

The senor inputs 46 are comprised of the masses sensor, heating sensors 64 exhaust rate sensors 72, the web mass sensors 70. The controls 50, of FIG. 3, are contained in the model-based controller to monitor web speed, as well as the information flowing from the other sensors.

There are multiple variable boundaries that are established for specific ovens and materials are installed into the model-based controller, so that the controller can monitor each step in the process to ensure that the boundaries are met. The multi variable first principles guidelines also contain modeling input 82 as well as problem solving scenarios.

Figure 3:
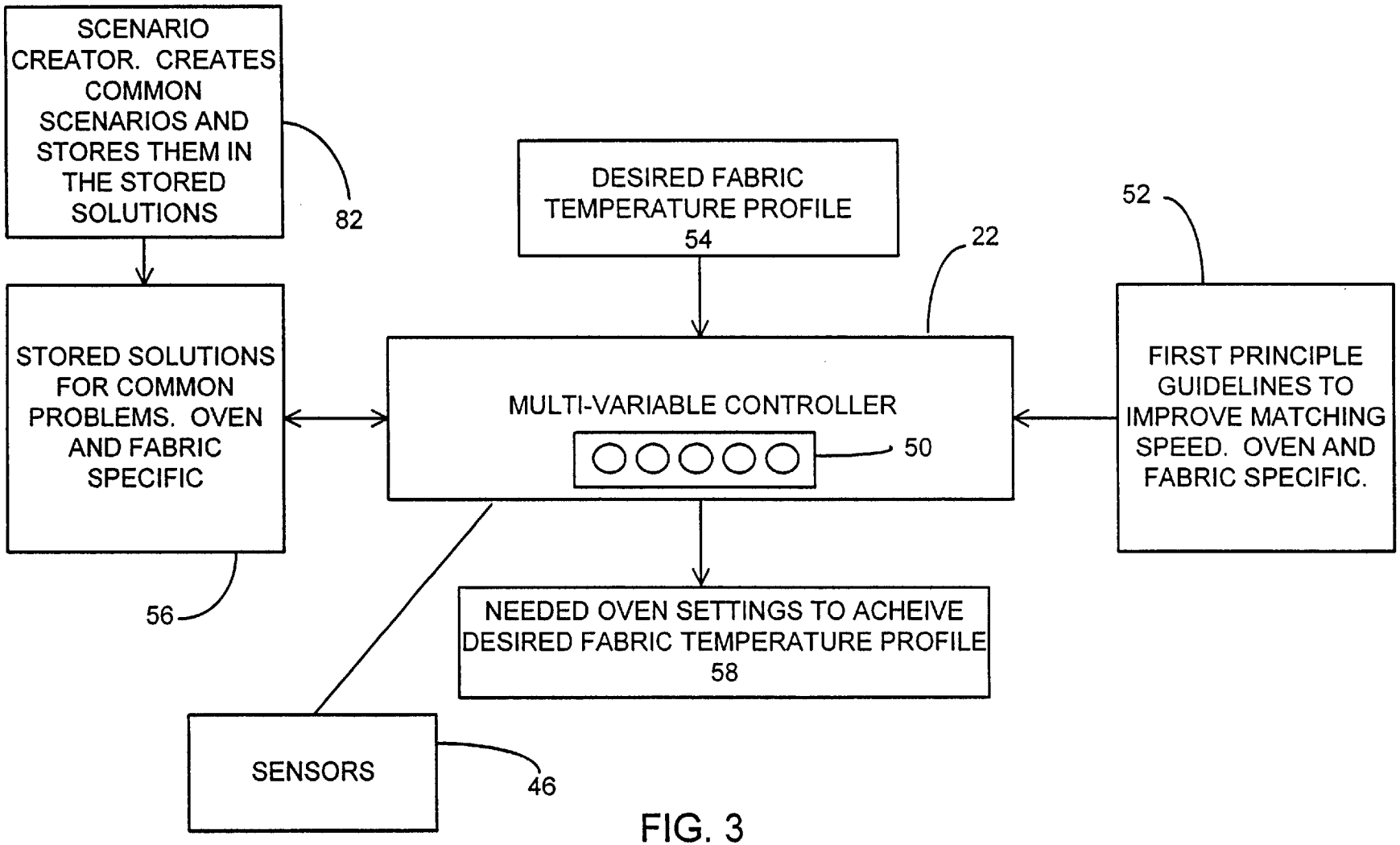
FIG. 3 is a block diagram of the inputs/outputs of a model-based controller.

Now referring to FIG. 3, the model-based controller 22 processes profiles and provides checks and balances to obtain the desired process as the material proceeds through the oven. The model-based 22 can be provided with process boundaries 52 which are oven-specific for other ovens. The translator module 56 further contains additional oven-specific boundaries to obtain processing criteria for various models and makes of ovens 82.

Boundaries are not first principle. They are oven and process specific. Boundaries are usually provided by the user and based on empirical data collection based on their equipment, such as "how much the burner can output", etc., in the process. Thus, the present invention takes into account first principles guidelines, oven boundaries, and process boundaries.

the model-based controller provides the checks and balance procedures to ensure that the desired results are obtained. The controller receives input from the sensors to ensure that each of the indicated sensors namely heat, web mass, exhaust and web speed are operating at the desired level and within the established parameters. The controller, with its software, is loaded with principle boundaries for specific ovens, problem solving scenarios and the ability to continually check and monitor the progress of the textile material as it moves through the oven.

the formula based lookup tables and other software processes, which are included within the controller, can provide a desired process profile 54 for a particular textile and oven in use at the time of the process. With the translator module 56, the controller 22, with its parameters, may be utilized with various ovens of different makes and models.

In operation, as the textile material passes through the oven 10, the controller 22 continually checks to make sure that the criteria established for that particular oven, and that particular textile, are being met at each step of the process. The various sensors 46 monitor the process of the textile fabric web 18 as it is moving through the oven process. If problems arise at any point in the process, the controller 22 will signal and indicate generally what the problem is and what the solution is to correct the problem. Utilization of the controller 22 permits the input of textile and oven-specific criteria into the controller 22 so that with any given oven, the desired results from the heating process for any given textile type may be obtained.

The controller 22 operates with sensors 46 at key points that provide information at each step in the operation ensuring that appropriate criteria are being met. The controller 22 indicates the acceptable parameters for specific ovens and textiles and whether the process is operating in an appropriate and proper manner on a given oven model. The controller 22 further contains the ability to determine when there is something wrong with the process and to suggest the appropriate direction to take to correct the problem.

The controller 22 is also provided with software containing formula based look up tables 56. The model-based controller 22 functions in a manner which provides input to the oven operation to ensure that the variables are set correctly, monitors those variables as the textile moves through the process in the oven 10 and provides signals 58 to correct any deviation from the parameters established for the appropriate treatment of the textile in the oven. The controller 22 is further constructed so that it can provide checks and balances of operation with any make or model textile oven and for a textile that requires continuous processing through an oven.

The above identified needs initially led to efforts to conserve energy mentioned above, which, in turn, led to the development of a computer simulation model for ovens and dryers that quantified energy usage, and provided the means of identifying how to alter operating parameters to optimize any thermal process to minimize energy usage and maximize quality related to thermal exposure. Implementation of the present invention not only achieves the goal of better energy management, but also results in process and production optimization, including significant increases in range speeds. In addition, the control system of the present invention accommodates the interconnectedness of variables defining the thermal treatment environment.

By using the laws of physics, energy and masses balance, and conservation of mass, momentum and energy, the present invention determines what happens to fabric as it passes through a tenter oven. Given defined variables for a specific process, the mathematical model calculates the evaporation rate of moisture in the fabric, the heat-up rate of the fabric, and the energy required to dry or heat set fabric. Thus, the present invention model identifies the point during the process at which the fabric is dry, the time required for the fabric to reach cure of heat set temperature, and the dwell time at the given temperature.

Typical benefits of the present invention include increased production down time, decreased energy consumption per "unit" of fabric, reduced production down time, improved fabric quality, smoke reduction, and improved production efficiency. In addition, by defining the distance to dry, the dwell time at temperature and the energy required to finish or heat set a fabric, an operator can vary process variables such as temperature, air flow, moisture content (wet pick-up), exhaust rates, and speed in computer simulations and can determine the optimum process conditions for any fabric style run on a modeled oven.

Certain modifications and improvements will occur to those skilled in the art upon a reading of the foregoing description. By way of example, while the present invention is particularly applicable to processing a textile fabric, it is also applicable to processing other webs, such as paper and plastics. Also, while in the preferred embodiment the present invention is used on a continuous oven, it is also applicable to batch ovens. It should be understand that all such modifications and improvements have been deleted herein for the sake of conciseness and readability but are properly within the scope of the following claims.

We claim:

1. A model-based controller for an oven for thermal treating a web, said oven including an oven chamber; a web transport for transporting a web through said oven chamber; heating means for heating said web in said oven chamber; and an exhaust system connected to said oven chamber, said model-based controller comprising:

(a) a plurality of sensor inputs;

(b) a plurality of control signal outputs;

(c) a multi-variable controller with oven and process boundaries for a first specific oven;

(d) a desired process profile; and (e) a translator module for permitting said desired process profile to be transferred to at least a second specific oven.

2. The apparatus according to claim 1, where in said sensor inputs receive measurements of web mass, temperature, air flow, and web speed.

3. The apparatus according to claim 2, further including a web mass sensor input.

4. The apparatus according to claim 2, wherein said air flow input sensor includes an exhaust rate sensor.

5. The apparatus according to claim 2, wherein said air flow input sensor includes an impingement air sensor.

6. The apparatus according to claim 1, wherein said plurality of control signal outputs includes a web speed control signal.

7. The apparatus according to claim 6, wherein said plurality of control signal outputs controls further includes a temperature control signal.

8. The apparatus according to claim 1, wherein said multi-variable controller with oven and process boundaries for a specific oven further includes a self-check module.

9. The apparatus according to claim 1, wherein said multi-variable controller with oven and process boundaries for a specific oven further includes a self-check module.

10. The apparatus according to claim 9, wherein said self-check module is a formula based lookup module.

11. The apparatus according to claim 1, wherein said translator module includes oven boundaries for at least a second specific oven and a boundary condition converter for producing new oven-specific boundaries for said second specific oven to attain said process profile.

12. An oven for thermal treating a web, said oven comprising:

(a) an oven chamber;

(b) a web transport for transporting a web through said oven chamber;

(c) heating means for heating said web in said oven chamber;

(e) a model-based controller for controlling the web temperature provide, said model-based controller including; (i) a plurality of sensor inputs; (ii) a plurality of control signal outputs; (iii) a multi-variable controller with oven and process boundaries for a first specific oven; (iv) a desired process profile; and (v) a translator module for permitting said desired process profile to be transferred to at least a second specific oven; and (f) an air delivery system.

13. The apparatus according to claim 12, further including at least one plenum and a circulation fan.

14. The apparatus according to claim 13, wherein said plenum further includes a plurality of air nozzles.

15. The apparatus according to claim 12 further including an air pressure sensor system.

16. The apparatus according to claim 15, wherein said air pressure sensor is a $\Delta P$ sensor.

17. The apparatus according to claim 12, wherein said oven chamber includes an enclosed housing, a web entrance and a web exit.

18. The apparatus according to claim 12, wherein said web transport includes a web let-off means and a web take-up means.

19. The apparatus according to claim 12, wherein said web transport further includes a web mass monitor.

20. The apparatus according to claim 19, wherein said mass monitor is a weight-speed monitor.

21. The apparatus according to claim 12, wherein said heating means is at least one of convection, radiant and conduction heating.

22. The apparatus according to claim 21, wherein said convection means is hot air heating.

23. The apparatus according to claim 21, wherein said radiant heating means includes infrared, radio frequency, or microwave heating.

24. The apparatus according to claim 21, wherein said conduction means is a steam heat drum.

25. The apparatus according to claim 12, wherein said exhaust system includes an exhaust duct.

26. The apparatus according to claim 25, wherein said exhaust duct further includes an exhaust fan.

27. The apparatus according to claim 12, wherein said sensor inputs receive measurements of web mass, temperature, air flow, and web speed.

28. The apparatus according to claim 27, further including a web mass sensor input.

29. The apparatus according to claim 27, wherein said air flow input sensor includes an exhaust rate sensor.

30. The apparatus according to claim 27, wherein said air flow input sensor includes an impingement air sensor.

31. The apparatus according to claim 12, wherein said plurality of control signal outputs includes a web speed control signal.

32. The apparatus according to claim 31, wherein said plurality of control signal outputs controls further includes a temperature control signal.

33. The apparatus according to claim 12, wherein said multi-variable controller with oven and process boundaries for a specific oven further includes a model input for problem scenarios.

34. The apparatus according to claim 12, wherein said multi-variable controller with oven and process boundaries for a specific oven further includes a self-check module.

35. The apparatus according to claim 34, wherein said self-check module is a formula based lookup module.

36. The apparatus according to claim 12, wherein said translator module includes oven boundaries for at least a second specific oven and a boundary condition converter for producing new oven-specific boundaries for said second specific oven to attain said process profile.

* * * * *

UNITED STATES PATENT AND TRADEMARK OFFICE

CERTIFICATE OF CORRECTION

PATENT NO. : 6,753,512 B1
DATED : June 22, 2004
INVENTOR(S) : Triplett et al.

It is certified that error appears in the above-identified patent and that said Letters Patent is hereby corrected as shown below:

Column 7,
Line 28, after section "(c)", insert -- (d) an exhaust system connected to said overn chamber; --
Line 30, "provide" should be -- profile. --

Signed and Sealed this

Tenth Day of August, 2004

JON W. DUDAS
*Acting Director of the United States Patent and Trademark Office*